United States Patent [19]

Stone

[11] 4,322,020

[45] Mar. 30, 1982

[54] INVERTIBLE PUMP SPRAYER

[76] Inventor: Raymond Stone, 177 Woodsdale Ave., Dover, Del. 19901

[21] Appl. No.: 110,211

[22] Filed: Jan. 7, 1980

Related U.S. Application Data

[63] Continuation of Ser. No. 902,055, May 2, 1978, abandoned.

[51] Int. Cl.[3] ..... B65D 35/28

[52] U.S. Cl. ..... 222/95; 222/105; 222/321; 222/394; 239/328

[58] Field of Search ..... 239/327, 328; 222/95, 222/105, 131, 183, 321, 303, 385, 386.5, 211, 212, 107, 94, 207, 209, 394

[56] References Cited

U.S. PATENT DOCUMENTS

| | | | |
|---|---|---|---|
| 3,211,346 | 10/1965 | Meshberg | 222/321 |
| 3,257,036 | 6/1966 | Micallef | 222/95 |
| 3,285,473 | 11/1966 | Fuhrmann | 222/107 |
| 3,420,413 | 1/1969 | Corsette | 222/107 |
| 3,938,708 | 2/1976 | Burger | 222/95 |
| 4,008,830 | 2/1977 | Meshberg | 222/95 |
| 4,051,983 | 10/1977 | Anderson | 222/321 |

*Primary Examiner*—H. Grant Skaggs
*Attorney, Agent, or Firm*—Craig and Antonelli

[57] ABSTRACT

An invertible pump sprayer is disclosed which enables a spray to be produced even with liquid material having viscosities as high as 100 cps. and regardless of the direction in which the spray is directed. The pump sprayer comprises a flexible container for containing the liquid material to be dispensed which collapses as the material therein is dispensed and a spray pump unit operatively associated with the flexible container. This unit includes a spray head for dispensing the material as a spray and a manually-operated pump for introducing the material to the spray head.

20 Claims, 3 Drawing Figures

INVERTIBLE PUMP SPRAYER

This is a continuation of application Ser. No. 902,055, filed May 2, 1978, now abandoned.

BACKGROUND AND SUMMARY OF THE INVENTION

The present invention relates to an invertible pump sprayer for dispensing a liquid material in the form of a spray in any direction. By a "spray" it is meant that the liquid is broken-up into individual particles.

It is desirable to apply many cosmetics and pharmaceuticals such as hair setting solutions, deodorants, antiseptics and anesthetics in the form of a spray, preferably in the form of a fine spray. One popular method of forming sprays has been by producing an aerosol containing a fluorocarbon propellant. This method is capable of placing a mist into the air having an average particle size range of about 50–500 microns from a pressurized container.

One of the disadvantages of forming such aerosols is the necessity of using a dispensing valve having an extremely fine-bore. Where the liquid material to be dispensed has a tendency to form a film, or where the liquid material is a solution of a solid substance, it has been a common experience that the valve becomes clogged and, generally, cannot readily be cleaned. As a result, the aerosol dispenser becomes useless and must be discarded before the contents have been completely used.

Another disadvantage stems from the recently aroused suspicion that the common, non-inflammable fluorocarbon propellants might be destroying the ozone layer of the upper atmosphere. Accordingly, other methods of applying deodorants and the like in the form of a spray have been tried. Two such methods are:

(1) The use of a manually-operated pump spray device, and (2) the use of a pressurized dual chamber container that separates the material to be dispensed from a propellant.

However, both of these methods have several disadvantages.

While pump sprays can provide a relatively fine spray, on the order of average particle sizes of about 100–500 microns, provided the viscosity of the product is no higher than approximately 40–45 cps. at room temperature, at viscosities higher than this they provide a very coarse spray or dispense the product in the form of a stream rather than a spray. Furthermore, many products even with viscosities below 40 cps., which form a spray at room temperature, form a stream at temperatures below room temperature.

A second disadvantage in the use of a pump spray device results from the fact that the device must be held in an almost upright position in order to function. When inverted or when held in a horizontal position after half or more of the contents has been emptied, the end of the dip tube or inductor is no longer in contact with the liquid and the liquid, therefor, cannot be pumped. This is particularly disadvantageous when applying anesthetics to various parts of the body since this usually requires that the device be held in a semi- or totally-inverted position.

A third disadvantage of the use of a pump spray device is that it is difficult to completely empty the device, particularly if, in use, the dip tube becomes bent and does not rest on the very bottom of the container portion of the device.

The aforementioned second method that has been tried to obtain a spray is by means of a dual chamber container wherein one chamber consists of an inner flexible container which contains the product to be dispensed. The top of this inner flexible container is connected to a dispensing valve. A perforated dip tube may be attached to the dispensing valve; if so, it extends to the bottom of the container. A rigid outer container encloses the flexible inner container. Propellant is provided in the space between the flexible inner container and the walls of the outer container. When the dispenser valve is opened, the pressure of the propellant vapor on the inner flexible container forces the product out of the container.

This container has certain advantages over the pump spray:

(1) It can be held in any direction, and (2) the product is almost completely emptied from the container.

However, it has three serious disadvantages.

(1) It dispenses most products in the form of a stream instead of a spray. Even with products having a viscosity of as low as 20–25 cps., only a coarse spray having an average particle size of about 1000 microns is obtained, and at viscosities of 35 cps. or higher, only a stream is obtained.

(2) Since a relatively high pressure is needed to obtain even a coarse spray, a very low boiling propellant is required. This causes problems in disposing of the used container. If a fluorocarbon is used, there is still the danger of affecting the ozone layer of the atmosphere should the container rupture after being discarded. If a low boiling hydrocarbon is employed, such as propane or isobutane, there is danger of fire or explosion.

(3) Again, because of the need for using a propellant, the outside container must be made of a material sufficiently strong to withstand the necessary high pressure. A metal container is the only type practical for this purpose. This has obvious disadvantages over the use of a plastic container which is lighter, less expensive and ecologically preferable.

It is a general object of the present invention to overcome all of the above disadvantages of the conventional aerosol container, the pump spray and the dual chamber container. More particularly, one object of the present invention is to provide a pump sprayer which, with the same liquid, provides a means of obtaining a finer spray than a conventional spray pump or a dual chamber aerosol. Another object is to provide a pump sprayer which provides a means of obtaining a spray even with viscosities as high as approximately 100 cps. Another object is to provide a sprayer for dispensing a spray regardless of the position in which the sprayer is held. A further object is to provide a sprayer in which the contents are emptied almost completely. An additional object is to provide a sprayer that will produce a spray at temperatures below room temperature. Another object is to provide a sprayer in which a propellant is not ordinarily required and, if one is used, wherein a relatively non-flammable, relatively low pressure propellant can be employed. A still further object is to provide a pump sprayer in which the outer container can be made of plastic.

These and the other objects which will become apparent to those skilled in the art are achieved in accordance with the present invention by providing a pump sprayer comprising means for containing the material to be dispensed which collapses as the liquid material therein is dispensed and a spray pump means operatively associated with the means that contains the material to be dispensed for dispensing the material as a spray.

In accordance with the present invention, it has been surprisingly discovered that, when a spray pump is used in combination with a collapsible container, not only is it possible to obtain a spray instead of a stream, but it is also possible to obtain such a spray with materials having viscosities as high as 100 cps.

In a preferred form of the invention, the means for containing the material to be dispensed is a flexible container made of suitable plastic material that is disposed within an outer rigid protective shell or container. Such an inner flexible container can, for example, be a flexible bag that collapses inwards or a flexible multi-pleated container of the type which collapses from the bottom upward. Usually, the flexible container is made of a plastic.

The flexible container disposed within the outer protective shell or container can be exposed to atmospheric pressure by providing at least one opening in the outer shell or container that communicates with the atmosphere. For example, the outer protective shell or container may be a perforated tubular-shaped member having a cylindrical side wall, a flat bottom end wall, and a flat or curved upper end wall with an opening through which the spray pump is inserted for fluid-tight connection with the flexible container disposed within the outer protective shell or container.

In another embodiment, the flexible container can be part of a dual chamber container having an outer rigid container spaced from the inner flexible container. The space between the flexible container and the outer rigid container is sealed so that a low pressure propellant can be placed in the space to promote collapse of the flexible container when because of the stiffness of the flexible container, greater than atmospheric pressure is required to cause it to collapse.

It will be appreciated that when a propellant is used, the outer container is ordinarily made of metal; but when no propellant is employed, the outer container can be and preferably is made of rigid plastic.

The spray pump used in accordance with this invention is identical to the conventional spray pumps which are commerically available with the exception that the dip tube or inductor portion is modified to suit the specific demands of the present invention. Thus, it will be understood that the spray pump includes conventional elements such as a spray head, spring biased valve and means for attaching the spray pump in fluid tight manner to the flexible container for the liquid material to be dispensed.

Additional features and advantages of the present invention will become more apparent from the following detailed description and the accompanying drawings which show, for purposes of illustration only, different embodiments of the present invention.

DETAILED DESCRIPTION OF THE DRAWINGS

Figure 1:
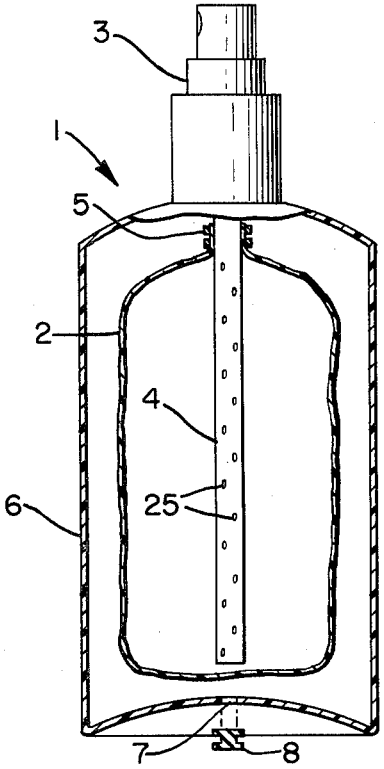
FIG. 1 is a schematic cross-sectional view of a pump sprayer according to a first embodiment of the present invention showing the use of a perforated dip tube.

In the embodiment of FIG. 1, a pump sprayer, designated generally by the reference character 1, according to the present invention, comprises a flexible container 2 in the form of a bag 2 for containing the material to be dispensed. The bag, which may be more or less flexible, is made of, for example, rubber, polyethylene, polypropylene, saran or polyvinyl chloride. A spray pump 3 is operatively associated with the bag 2 for dispensing the material therein as a spray. In particular, the upper, open end of the bag is sealingly fastened to the upper end of the dip tube or inductor 4 by means of a fastening or clamping means 5. Thus, a vacuum is created within bag 2 as the liquid material is pumped out. Because of the presence of atmospheric pressure or a low pressure propellant around the bag, the bag collapses about dip tube 4 as the material in the bag is dispensed by means of spray pump 3. The material within the bag is thus maintained in contact with the dip tube 4. Furthermore, by providing dip tube 4 with a plurality of perforations 25 over most of its length within the bag 2, as shown in FIG. 1, the liquid will always be able to enter the dip tube regardless of how the bag collapses around the tube. Also, this arrangement insures that the liquid will always be accessible to the pump mechanism that draws the liquid material from the bag, regardless of the position of the sprayer.

The flexible bag 2 is an inner flexible container positioned within an outer rigid protective container 6. This rigid outer container 6 has an opening 7 in the bottom thereof so that the inner flexible bag 2 can be exposed to atmospheric pressure. It will be understood, however, that the outer container may have several perforations and can be in the form of a screen-like shell.

Although not ordinarily necessary, the use of a propellant is worthwhile when the inner plastic container is flexible but difficult to collapse by atmospheric pressure, i.e. about 15 psi. If a propellant is used, a maximum pressure of 30 pounds per square inch is ordinarly employed. Usually no more than 20 pounds per square inch is needed. This makes it possible to use relatively nonflammable propellant mixtures. Examples of these are mixtures of 0.5–0.8 parts of propane with 10 parts of trichloroethylene, methylene chloride or perchloroethylene and mixtures of 0.2 parts of butane and 0.3–0.5 parts of propane with 10 parts of perchloroethylene, given in parts by weight. If a propellant is used with the pump spray 1 in FIG. 1, the rigid outer container is made of metal and the propellant is introduced through the opening 7. This is closed with the plug 8 after the propellant is injected. If no propellant is used, the plug is left out.

Figure 2:
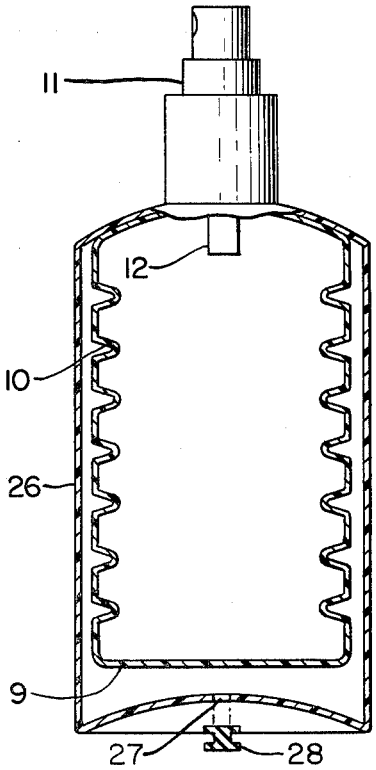
FIG. 2 is a schematic cross-sectional view of a pump spray according to a second embodiment of the present invention showing the use of a foldable inner container and a short dip tube.

In the embodiment of FIG. 2, the flexible container 9 is formed with folds 10 so that the container collapses, accordion fashion, from the bottom upward within the dual chamber container as the material within the container 9 is dispensed with the spray pump 11. Again, as with the embodiment of FIG. 1, the collapsing is effected as a result of the vacuum which is created within the flexible container 9, which is sealingly arranged about the dip tube 12, when material is pumped out of the flexible container. The atmospheric pressure or, if deemed necessary, a low pressure propellant around the flexible container cause the container to collapse when the spray pump is actuated as discussed above with respect to the embodiment of FIG. 1. Dip tube 12 extends only a short distance into the inner flexible container 9 at the top thereof so as not to interfere with the upward movement of the bottom of the flexible container during collapsing thereof. Also, as in the embodiment of FIG. 1 the sprayer comprises an outer rigid container 26, with at least one opening such as opening 27 in the bottom thereof so that the inner flexible bag 9 can be exposed to atmospheric pressure if no propellant is used. If a propellant is used, however, a single opening 27 is provided and is closed with plug 28 after the propellant is injected.

Figure 3:
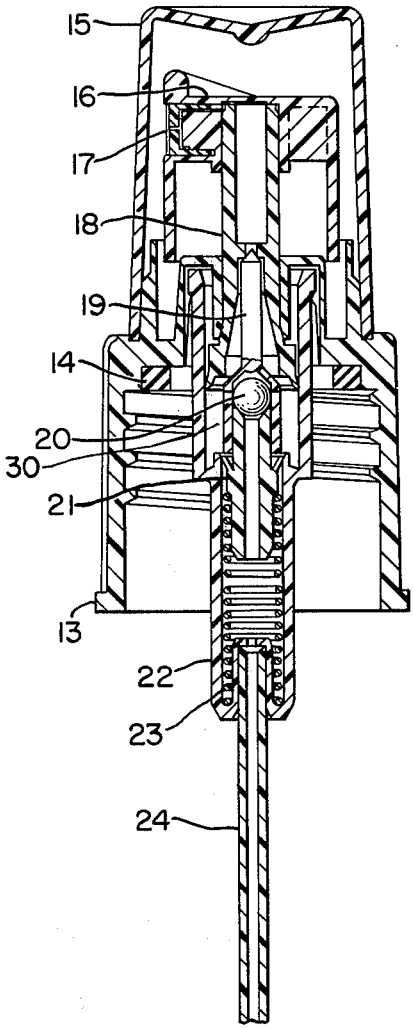
FIG. 3 is a schematic cross-sectional view of a suitable pump for use with the pump spray of the present invention.

FIG. 3 shows a suitable, commercially available fine mist spray pump for use with the pump spray of the present invention. The spray pump comprises a shroud or closure 13 with a gasket 14 for connection with, for example, either of the dual chamber containers of FIGS. 1 and 2. A removable hood 15 covers the spray head 16 of the spray pump. The spray head is provided with an orifice cup 17 and is connected to a piston 18. Additional components of the spray pump include a poppet or pressure actuated discharge valve 19, a spherical valve 20, a seal valve 21 and an accumulator 22 enclosing a spring or responser 23 and an expansible/-contractible pressure accumulating chamber 30. A dip tube or inductor 24 is connected to the lower end of the accumulator 22 as shown in FIG. 3.

With the type of spray pump shown in FIG. 3, constant pressure spray (non-throttling) is provided and spray delivery of the product is consistent no matter whether stroked gently or firmly.

Typically, a spray pump such as shown in FIG. 3 will have an orifice diameter of about from 0.008 inch to 0.032 inch; preferably about from 0.011 inch to 0.015 inch; more preferably about 0.012 inch. Surprisingly, when a pump having a range of orifice openings, as noted, is used in conjunction with a dual chamber container, a spray, as defined above, can be obtained even with a product having a viscosity as high as approximately 100 cps. As might be expected, of course, the particle size of the spray will vary with the rheology of the liquid being sprayed as well as with the orifice size. In general, however, the lower the viscosity of the liquid and the smaller the orifice size, the smaller the particle size obtained.

EXAMPLE 1

A topical anesthetic solution was prepared having the following composition:

| | |
|---|---|
| Polyethyleneglycol 400 Monolaurate | 40.0 |
| Benzocaine | 10.0 |
| Ethanol | 19.1 |
| Water | 30.9 |

The viscosity of this solution was 38 cps. at 20° C. A pump sprayer as shown in FIG. 2, having an outer container composed of rigid polyethylene and an inner container composed of flexible polyethylene and fitted with a spray pump sold commercially as "Calmar Mistette Mark 2", having an orifice measuring 0.012 inch, as shown in FIG. 3, was filled with the above anesthetic solution. The plug 25 was omitted so that the space between the inner and outer containers was in direct communication with the atmosphere. When the pump was operated, a spray was discharged having an average particle size of approximately 200 microns. The rate of settling compared favorably with that of a conventional aerosol. Also, the same spray was obtained when the sprayer was inverted.

The above container was cooled to 10° C. When the pump was operated, the results were essentially the same as at room temperature. (Such anesthetic sprays might be used at temperatures substantially below room temperature if employed out of doors at lower winter temperatures, for example, at fires or at outdoor sporting events).

EXAMPLE 2

For comparison, a plastic bottle was fitted with the same spray pump and filled with the same anesthetic solution as in Example 1. When the pump was operated with the solution at room temperature, a coarser spray was obtained then in Example 1, i.e. one having an average particle size of about 400 microns. When the pump was operated with the container in an inverted position, no product was discharged.

The above container was cooled to 10° C. When the pump was operated even with the container in the upright position, the solution was discharged only in intermittent spurts in the form of a stream.

EXAMPLE 3

For additional comparison, the spaces between the inner and outer chambers of two dual chambered dispensers, each fitted with a conventional aerosol spray valve, were filled, one with a mixture of Freon 11 and Freon 12 to provide a pressure of 50 psi. and the other with a mixture of propane and butane to provide a pressure of 60 psi. The flexible container of each dispenser was filled with the topical anesthetic solution of Example 1. Upon depression of the spray valves, a continuous stream of liquid flowed from each dispenser and a spray could not be obtained.

EXAMPLE 4

A pump sprayer as shown in FIG. 1, having an outer container composed of rigid polystyrene and an inner container composed a flexible polyvinyl chloride and fitted with a spray pump sold commerically as "Calmar Mistette Mark I", having an orifice measuring 0.009 inch, was filled with an anesthetic solution similar to that of Example 1 but having a viscosity of 60 cps. at room temperature. The plug 8 was omitted so that the space between the inner and outer containers was in direct communication with the atmosphere. Pumping resulted in the production of a spray having an average particle size of about 500 microns. Results were the same in the inverted as in the upright position.

EXAMPLE 5

The anesthetic solution of Example 4 was used in Example 2 in place of the anesthetic solution of Example 1. When the pump was operated, only a stream could be obtained.

EXAMPLE 6

Example 1 was repeated except that the outer container was composed of metal and the inner container was composed of an accordion-shaped polyethylene bag which is difficult to collapse under atmospheric pressure, the plug 28 was inserted and the space between the inner and outer containers contained a mixture composed of 0.8 parts of propane and 10 parts of trichloroethylene, the pressure within the space being about 30 psi. When the pump was operated, the results were essentially the same as in Example 1, i.e. a spray was obtained.

While I have shown and described only several embodiments in accordance with the present invention, it is understood that the same is not limited thereto but is susceptible of numerous changes and modifications as would be known to those skilled in the art, given the present disclosure. I therefore do not wish to be limited to the details shown and described herein but intend to cover all such changes and modifications as are encompassed by the scope of the appended claims.

I claim:

1. An invertible pump sprayer for dispensing a liquid material having a viscosity as high as 100 cps. as a fine spray regardless of the position in which the sprayer is held; said pump sprayer comprising a flexible inner collapsible container for containing the liquid material to be dispensed arranged within a protective rigid outer container, and a spray pump means operatively associated with said flexible container for dispensing the liquid material therein as a fine spray of individual liquid particles, without the formation of a liquid stream; said spray pump means including a manually-operated pump means for pumping the liquid material from said flexible container, said pump means having a pressure accumulating chamber and a pressure-actuated discharge valve for discharging liquid material from said chamber only when the pressure in the chamber is above a predetermined value, and a spray head means for atomizing the liquid material supplied by said pump means, the pump means and the pressure of the atmosphere surrounding the flexible container cooperating to collapse said flexible container and to supply sufficient liquid material under pressure to said spray head means whereby said spray head means produces said fine spray.

2. The pump sprayer according to claim 1, wherein the inner flexible container is a flexible plastic bag.

3. The pump sprayer according to claim 2, wherein the inner flexible bag is exposed to atmospheric pressure via at least one opening provided in the outer container.

4. The pump sprayer according to claim 2, wherein a low pressure propellant is provided about the flexible bag and within the outer container, the pressure of said propellant being sufficient to promote the dispensing of a liquid material normally incapable of being dispensed from said flexible bag as a fine spray and not exceeding 30 pounds per square inch.

5. The pump sprayer according to claim 2, wherein the spray pump means includes a perforated dip tube which extends substantially into said flexible bag, said flexible bag collapsing around said dip tube as the material in the flexible bag is dispensed.

6. The pump sprayer according to claim 1, wherein the inner flexible container collapses from the bottom upward within a chamber provided in said outer container.

7. The pump sprayer according to claim 6, wherein the inner flexible container is exposed to atmospheric pressure.

8. The pump sprayer according to claim 6, wherein a low pressure propellant is provided around the inner flexible container within the outer container, the pressure of said propellant not exceeding 30 pounds per square inch.

9. The pump sprayer according to claim 6, wherein said spray pump means includes a dip tube which extends only a short distance into said inner flexible container at the top thereof so as not to interfere with the upward movement of the bottom of said flexible container during collapsing thereof.

10. The pump sprayer according to claim 1, wherein the inner flexible container within the outer container is exposed to atmospheric pressure.

11. The pump sprayer according to claim 10, wherein the pump sprayer comprises a rigid outer container with an opening in the bottom thereof, said inner flexible container within the outer container being exposed to atmospheric pressure.

12. The pump sprayer according to claim 1, wherein a low pressure propellant is provided about the inner flexible container within the outer container.

13. The pump sprayer according to claim 12, wherein said propellant is non-flammable and wherein the propellant pressure does not exceed 30 pounds per square inch.

14. The pump sprayer according to claim 13, wherein said propellant is a mixture of trichloroethylene and propane.

15. The pump sprayer according to claim 13, wherein said propellant is a mixture of perchloroethylene, propane and butane.

16. The pump sprayer according to claim 12, wherein the pump sprayer comprises a rigid outer container with an opening in the bottom thereof for introducing said propellant, and plug means for closing said opening to retain said propellant about the inner flexible container within the outer container.

17. The pump sprayer according to claim 1, wherein the rigid outer container is made of plastic.

18. The pump sprayer according to claim 1, wherein said spray pump means further includes an inductor for withdrawing liquid material from said flexible container and means for sealingly connecting said flexible container to said inductor.

19. The pump sprayer according to claim 1, wherein said spray pump means further includes an inductor for withdrawing liquid material from said flexible container and clamping means for fastening said flexible container to said inductor.

20. The pump sprayer according to claim 1, further comprising means for sealingly securing said flexible container to said spray pump means whereby a vacuum is created within said flexible container as the liquid material is pumped out by said spray pump means.

* * * * *